United States Patent [19]

Borodin

[11] Patent Number: 4,872,923

[45] **Date of Patent: * Oct. 10, 1989**

[54] DIE-LESS DRAWING METHOD AND APPARATUS

[75] Inventor: Daniel J. Borodin, Warren, Mich.

[73] Assignee: U.S. Automation Co., Detroit, Mich.

[ * ] Notice: The portion of the term of this patent subsequent to May 2, 2006 has been disclaimed.

[21] Appl. No.: 104,684

[22] Filed: Oct. 5, 1987

Related U.S. Application Data

[63] Continuation-in-part of Ser. No. 80,605, Aug. 8, 1987, Pat. No. 4,826,542.

[51] Int. Cl.[4] ..... C21D 8/00

[52] U.S. Cl. ..... 148/11.5 R; 148/12 R; 148/12 B; 148/12.4; 148/128

[58] Field of Search ..... 148/12.4, 12 B, 12 R, 148/130, 128, 13, 11.5 R

[56] References Cited

U.S. PATENT DOCUMENTS 3,964,938 6/1976 Tolliver et al. ..... 148/12 B

OTHER PUBLICATIONS

Making Shaping & Treating of Steel 9th ed. ©1971 pp. 607–609, 1100–1086, 1089, 1091.

*Primary Examiner*—Christopher W. Brody

*Attorney, Agent, or Firm*—Charles W. Chandler

[57] ABSTRACT

Method and apparatus for heating, cooling and stretching a metal specimen as it is being elongated, according to a temperature curve selected to provide a finished product having a predetermined microstructive, ultimate tensile strength, yield point and cross-section.

26 Claims, 2 Drawing Sheets

DIE-LESS DRAWING METHOD AND APPARATUS

Cross-Reference to Related Application

This application is a continuation-in-part of application Ser. No. 080,605 filed Aug. 8, 1987 for "Method and Apparatus for Forming Bainite", now U.S. Pat. No. 4,826,542.

BACKGROUND OF THE INVENTION

This invention is related to the Thermastress process and apparatus for the die-less drawing of metal, such as, but not limited to, a low carbon steel, to obtain a predictable microstructure, tensile strength, and reduction in cross-section.

The Thermastress process is a thermo-mechanical process initially developed for producing steel and steel alloys with remarkable physical characteristics. The process differs from conventional methods for treating steel by deforming the heated steel material simultaneously with a rapid cooling step. The transformation of Austenitized steel is accomplished by an apparent shift of the critical temperature for producing Bainite ($B_s$) brought about by the simultaneous application of stress and plastic deformation on the steel during the cooling cycle. The process inherently tends to produce Bainite rather than Martensite.

My earlier process was disclosed in U.S. Pat. No. 3,964,938 which issued June 22, 1976 for a "Method And Apparatus for Forming High Tensile Steel from Low and Medium Carbon Steel".

The basic Thermastress process involves moving material between two spaced driving means immediately adjacent heating and quenching zones. The effect of the two zones is to impose a temperature gradient on the material between the two drives so that after a gradual temperature rise, for example, to around 2,000° F., the processed material is rapidly cooled.

The processed material is stretched as it passes through the heating zone, where the yield strength of the material is substantially lowered. A condition of dynamic equilibrium occurs as the material accelerates toward the downstream drive, establishing a very stable cross-section reduction profile with the cross-section of the processed material being reduced in inverse proportion to the increase in velocity. The final reduced cross-section of the material remains constant within very close dimensional tolerances.

In the case of low and medium carbon steel, the effect of a rapid cooling, as the material passes from the heating zone into the quenching zone, in conjunction with the plastic flow taking place, is to substantially modify the steel microstructure. The fine grained micro-structure, thus produced, increases the ultimate tensile strength as high as 220,000 p.s.i. and above at diameters, exceeding by a factor greater than 10, the thickness of high strength steel produced by the rapid quenching of conventional heated-finished low carbon sheet steel.

One phenomenon related to the commercial Thermastress process is that the critical temperature, at which the microstructure of steel nucleates to Bainite and Martensite, as its temperature is being reduced, shifts upwardly, compared to the conventional time temperature transformation curves for the micro-structure of such steels.

The finished microstructure of the specimen determines the ultimate strength of the material. Several factors determine the final microstructure. For example, the heating rate is important as well as the cooling rate. The velocity of the material as it passes through the heating and cooling zones is also important.

Other factors that determine the ultimate microstructure include the initial thickness or diameter of the material, the chemistry of the material, the desired finished size, thickness or diameter, the desired ultimate tensile strength as well as the tolerance range of the specimen's yield point.

Some of the problems which have prevented die-less processes from succeeding in commercial applications include variations in the longitudinal cross-section, sometimes referred to as "necks" or "eggs", and the difficulty in attaining a smooth and even surface finish.

One approach to accommodate variations in the chemistry of the steel, is to vary the amount of heat applied to the material, however, this is undesirable because changing the heat input influences the microstructure of the finished material. The cooling rate also influences the strain rate hardening rate.

SUMMARY OF THE INVENTION

The broad purpose of the present invention is to improve the Thermastress process and apparatus for the die-less drawing of steel or other alloy materials so that the final material has a uniform predetermined microstructure. Another purpose of the invention is to obtain a close tolerance end product. Still another object is to control the various production variables for the die-less drawing of steel by means of a computerized control. Another object is to maintain stability of the reduction cone, making a commercial application possible. A further object is to obtain a desired microstructure by a computer-controlled process.

To understand the die-less process control concepts, it is desirable to understand the process theory. The process has been tested to derive control equations for achieving a predictable, close tolerance material suitable for commercial production. The tests have varied the values of the material velocity, such as wire, as it enters the stage in which it necks or is reduced in diameter, with the other process variables remaining constant. Other experiments have varied the value of the elongation rate, with the remaining variables maintained constant. Still further experiments varied the value of the temperature along the temperature gradient.

Some of the factors with which the present invention is concerned are the roles of strain, strain rate, and temperature for determining the change in the material cross-section as it is being elongated during the heating process.

The preferred embodiment of the invention provides a method having a closer control over the microstructure and therefore the Ultimate Tensile Strength and the Yield Point of the finished material. This is achieved by establishing a predetermined heating rate gradient and a predetermined cooling gradient for the product in process. The shape of the temperature gradients are determined from the known physical characteristics of the raw material such as the steel chemistry, the original or initial diameter of the material and the requirements of the finished product such as the desired finished size, the yield point, and the ultimate tensile strength. The material is then processed through the heating and quenching zones with various heat sensors at stations along the path of the material to automatically control heating and cooling means to establish and maintain the ideal temperature gradient according to the cross-section of the material until the time it commences cooling. The process maintains the ideal cooling rate during the cooling cycle to achieve the desired recrystalization kinetics.

Preferably, a series of heating burners are disposed along the path of the material, each maintaining the material passing through that zone at a particular mean temperature according to the heating gradient. Similarly, quenching nozzles are disposed along the path of the material, after it has reached its peak temperature, to reduce the material temperature to levels dictated by the cooling gradient. The velocity of the material as it enters the heating and cooling zones is modulated to vary the strain rate hardening. The velocity is varied according to variations in the flow stress of the material in the reduction cone as reflected by the load cell reading which monitors the force required to achieve the reduction cone cross-section. The purpose for modulating the velocity, of the material coming into the reduction zone is:

(a) to vary the strain rate hardening since it is proportional to the velocity; and (b) to vary the cooling rate, thereby compensating for small variations of carbon content which occur within the same heat of steel.

The idea is to achieve a given microstructure that is consistent with a desired ultimate tensile strength, to provide a close tolerance material after it has been reduced by elongation, and to eliminate variations in the product cross-section. In addition, the invention provides a stable process for strengthening materials or providing a broad range of desirable microstructures.

Still further objects and advantages will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENT

Although the embodiment of the invention illustrated is for the die-less treating of low carbon steel wire, it appears feasible to utilize the invention on sheet, strip and bar stock as well as various alloy steels, exotic alloys such as high nickel alloys, nonferrous metals, such as aluminum, copper alloys and aluminum bronze for obtaining the desired cross-section within close tolerances or for other purposes such as providing a product having a desirable microstructure.

The system is intended to be totally automated and computer-controlled. An earlier version of a complete system is illustrated in my prior U.S. Pat. No. 3,964,938. This application is primarily concerned with establishing and maintaining a highly stable condition within the reduction cone as well as more precisely controlling the heating and quenching steps. Although the wire can be pretreated and prereduced before being heated, and precision sized and coiled after being cooled, the emphasis in this application is toward the heating, cooling and elongating steps to provide a predictable uniform microstructure and a product with a cross-section within close dimensional tolerances.

Figure 1:
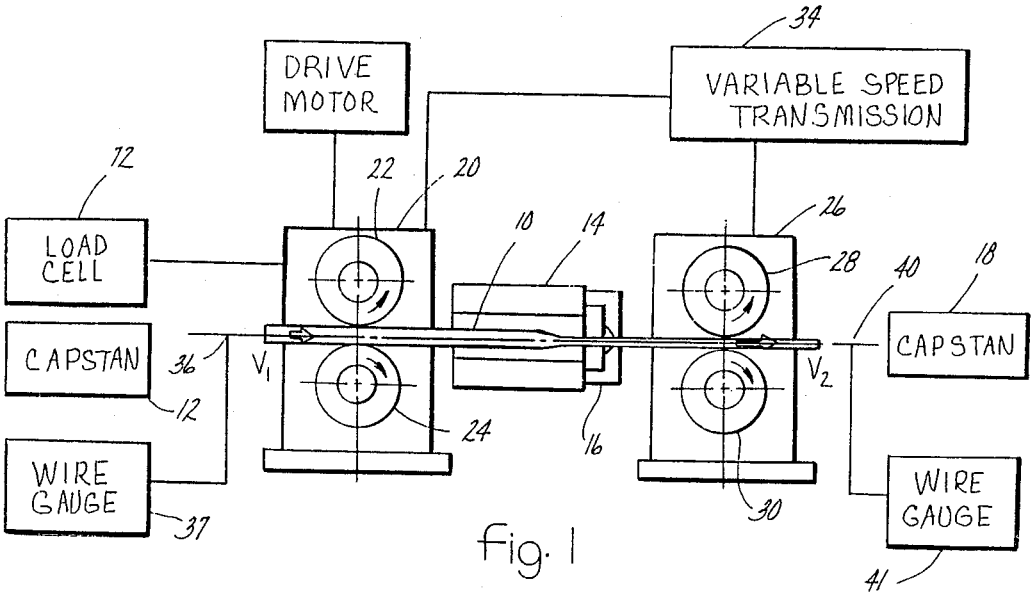
FIG. 1 is an elevational schematic view of apparatus for processing a specimen of steel wire in accordance with the preferred method.

Referring to FIG. 1, wire 10 is delivered from a feeder capstan 12, heated in heating apparatus 14, cooled in quenching apparatus 16, and wound or coiled in take-up capstan 18.

Wire 10, for illustrative purposes, is an SAE 1010 low carbon steel.

The steel wire is unwound from capstan 12 by upstream drive means 20 which, for illustrative purposes, comprises a pair of roller means 22 and 24. The roller means rotate in opposite directions and engage the wire to apply a driving force in the downstream direction, from left to right in the direction of the arrows. Similarly, downstream drive means 26 includes a pair of rollers 28 and 30 which also engage the wire to advance it in the downstream direction.

Drive motor means 32 is connected to the upstream drive means for rotating rollers 20 and 22. The upstream drive means is connected to a variable speed transmission 34 which drives rollers 28 and 30 so that the downstream rollers rotate at a rate that is greater than that of the upstream drive means, as the wire is being elongated.

A very intense heat is applied to the wire as it is advanced through heating means 14. The wire temperature increases to a level in excess of the Austenite conversion point of the wire to cause the yield point of the wire material to drop below the level of the stress being applied by the upstream and downstream drive means.

As the wire is advanced through the system, its diameter is measured at point 36 by laser gage 37 for determining the original untreated diameter of the wire; at point 38 by laser gage 39 for determining the diameter of the wire as it enters the heating means; and at point 40 by laser gage 41 for monitoring the finished diameter of the wire.

The heating means receives fuel heat from a source 42, which may be a combination of oxygen and propane, adapted to direct flame through a series of independently controllable ring burners 44, 46 and 48. The burners are coaxial to the path of motion of the wire and progressively heat the wire as it moves downstream. As the wire progresses through the heating zone and enters the quenching zone, its diameter is reduced as at 50. The wire enters the quenching zone where a source 52 of a quenching medium delivers the latter to independently controllable nozzles 54, 56 and 58 which control the cooling temperature gradient of the wire.

Thus the temperature gradient of the wire, as it advances through the heating and quenching means, is closely controlled and maintained within close tolerances.

The heating burners, for illustrative purposes, are located adjacent heating zones $H_1$, $H_2$ and $H_3$. The quenching nozzles are located adjacent quenching zones $Q_1$, $Q_2$ and $Q_3$. A greater number of heating and quenching zones can be provided, depending upon the degree of precision the user desires for the actual temperature gradient, and the material velocity.

Computer control means 60 is connected to the heating burners and the quenching nozzles for adjusting them depending upon the input from various factors being monitored, as will be described.

For illustrative purposes, the wire is heated to follow a temperature gradient curve, generally indicated at 62, in which the temperature is increased on the positively sloped side 64 of the curve, and reduced on the negatively sloped side 66 of the curve. Curve 62 represents the desired temperature gradient of the wire moving adjacent the heating burners The maximum temperature is at point 68 which is above the Eutectoid temperature of the material. The wire is cooled according to side 66 of the curve.

The temperature gradient curve can be provided with a plateau, as illustrated at 70, the Bainite nucleation temperature of the wire. It may be maintained at this plateau to provide a predetermined microstructure corresponding to a desired Bainite ratio in the material as is more fully disclosed in my co-pending application, Ser. No. 80,605, filed Aug. 8, 1987, for "Method and Apparatus for Forming Bainite".

Referring to FIG. 1, load cell 72 measures the net tensile load $P_d$ being applied by the roller means on the moving wire.

Figure 3:
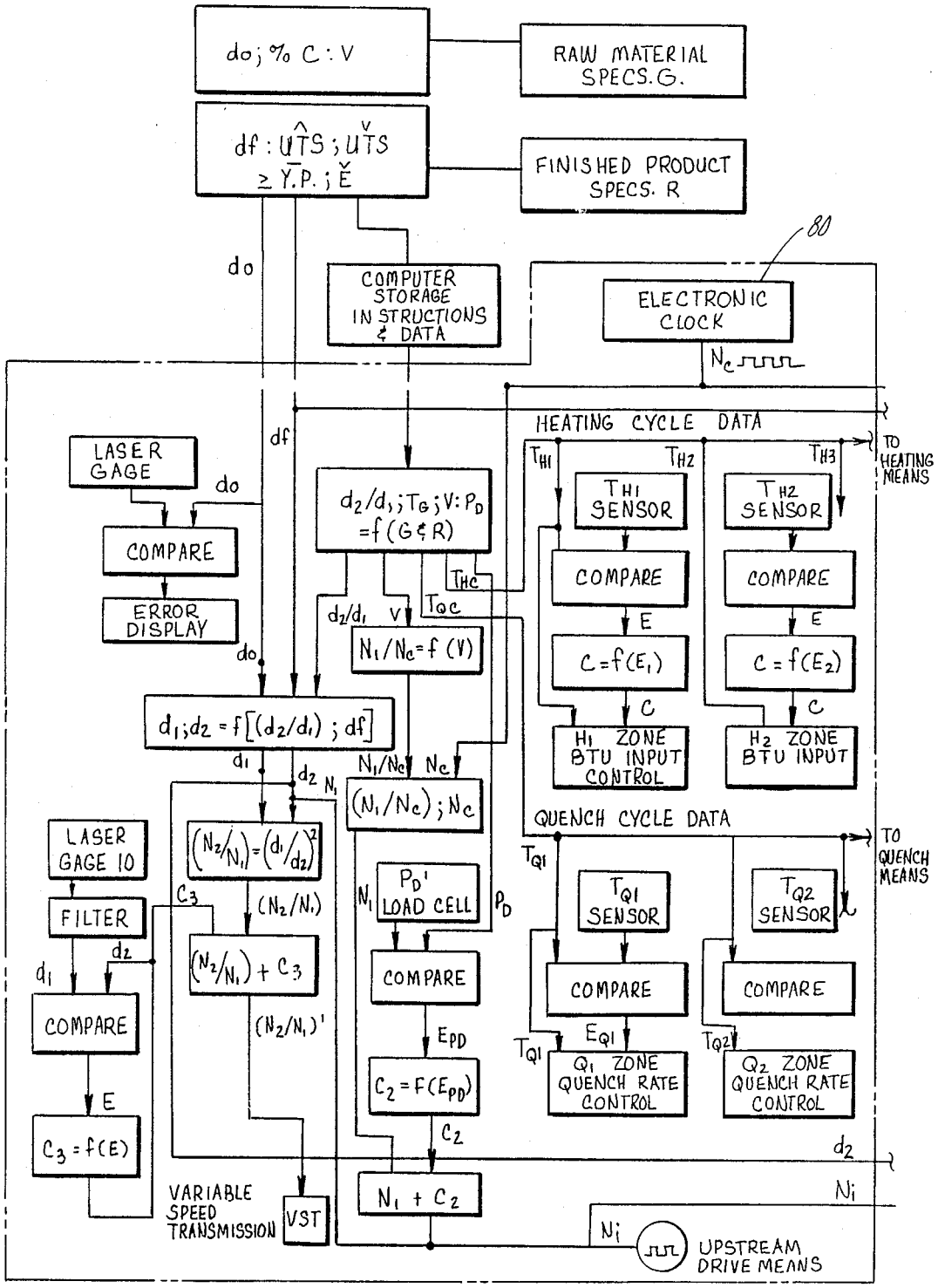
FIG. 3 is a logic diagram for controlling the heating and cooling sections of the preferred apparatus and also the elongation and reduction in the cross-sectional area of the material being processed.

A logic diagram for controlling upstream drive means 20, downstream drive means 24 and the heating and quenching means is illustrated in FIG. 3. The logic can be carried out in a conventional digital control computer with a programmable controller.

The logic circuit maintains stability of the reduction cone thereby assuming close tolerances and consistent cross-section of the processed material.

Beginning at the top of the logic diagram, the user enters the following data into the data entry phase of the system:

"$d_o$", the initial diameter of the wire as it enters the system;

"% C" which is the carbon content of the wire;

"Y" is data pertaining to the steel chemistry such as the percent of molybdenum, nickel chromium, etc.;

"$d_f$" is the finished diameter desired of the wire;

Max. UTS and Min. UTS data define the range of the desired ultimate tensile strength of the wire;

Max. Y.P. and Min. Y.P. define the yield point range desired of the finished wire;

"E" is data pertaining to the elongation characteristics of the finished material.

The $d_o$ data is fed to a set of instructions which compare the specifications of the original diameter of the wire with the actual diameter of the wire as read by laser gage 37. If there is a difference, the error "E" is displayed on an error display device. Other wire material characteristics can also be compared. For example, the chemical specifications of the wire given the user against the actual specifications of the wire being treated, can be compared by making a spectroscopic examination of the latter to determine if there is a substantial difference.

The computer makes a decision based on the software available, the material whose chemistry is identified by % C, the Y data entry, the G, UTS and Y.P. values requested in data entry portion, as to how much reduction in area should be called for in the thermomechanical portion of the process and how much in the preceeding and succeeding portions of the system.

Figure 2:
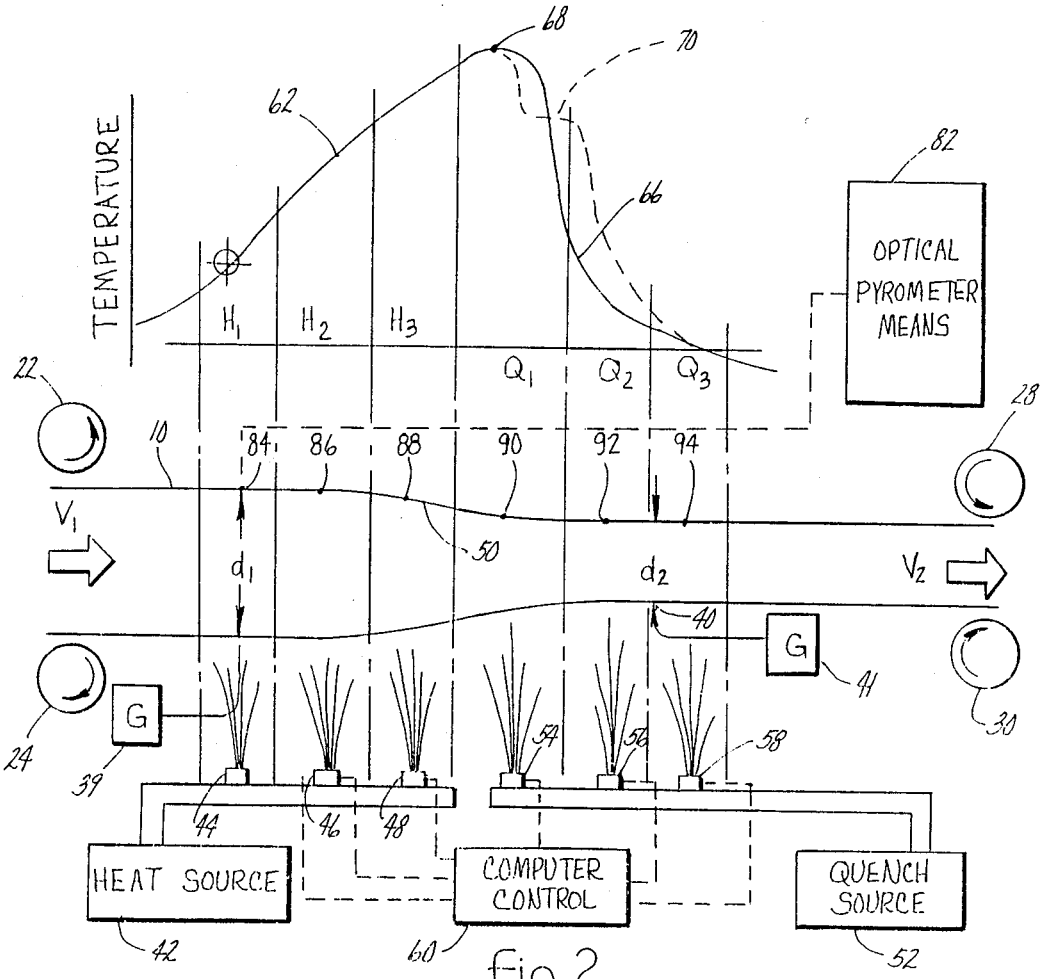
FIG. 2 is an enlarged schematic view illustrating the manner in which the reduction section of the steel specimen is heated and cooled to accommodate a given heating and cooling curve.

Wire diameter $d_1$, monitored by gage 39, is continuously fed to the computer with diameter $d_2$ at point 40, as illustrated in FIG. 2, and factored with the desired finished diameter of the wire. The output of this information is then used to determine the r.p.m., $N_2$, of the downstream drive means as a function of $N_1$, the r.p.m. of the upstream drive means. The desired finished diameter is compared to the actual diameter $d_2$ at point 40 to determine correction factor "$C_3$". The correction factor is functioned in with ratio $N_2/N_1$ to determine a $N_2/N_1'$ which is used to either increase or reduce the speed-up ratio of the variable speed transmission 34.

The diameter of the wire exiting from the cone reduction section, in the heating and quenching zones, is continually monitored and the downstream drive means continually corrected according to any errors detected in $d_2$ so that the final finished diameter is within predetermined tolerances.

Another factor continuously controlled is the velocity $V_l$, of the wire being advanced through the system. The velocity information together with the reduction ratio, that is, $d_2/d_1$ is used in connection with electronic clock 80. This information then determines the r.p.m. of the upstream drive means by a comparison with the clock, referred to as $N_c$. Velocity V, is continually modulated according to changes in the reading of the load cell $P_d$, caused for example by variations in the wire chemistry or heat conductivity.

Load cell information $P_d$ is monitored and compared to the ideal $P_d$ computed from the data available to determine any differences. The load cell information is continually monitored to provide input to $N_1$, the r.p.m. of the upstream drive means.

The heating data is used to provide heating cycle data by comparing the actual temperatures as read by optical pyrometer means 82 at points 84, 86, 88. The temperatures can be monitored at a greater or lesser number of points.

The temperature information at point 84 is used to control the heat provided by burner 44. The temperature read at point 84 is compared to the temperature at the corresponding point of gradient curve 64. Any error generates a correction signal which is sent to burner 44 to either increase or reduce the temperature. Similarly, the temperature data in heating zones $H_2$ and $H_3$ are provided for making corrections to the heat delivered by burners 46 and 48.

The temperature data read by the pyrometer means at points 90, 92 and 94 is employed to provide quenching cycle feedback data. For example, in quenching zone $Q_1$ the temperature is read at 90' for controlling the cooling rate of quenching nozzle 54. The actual temperature is continually monitored and compared to the temperature curve to provide continuous correction signals proportional to the value and sign of the error. Thus the quenching temperature in each of the Q zones is either increased or reduced at nozzles 54, 56 and 58 according to the data feedback from zones $Q_1$, $Q_2$ and $Q_3$.

The computer control system has been described for continually monitoring the temperature gradient of the wire as it is being advanced through the heating and quenching means, and comparing the actual gradient to a temperature curve chosen to provide a particular microstructure.

The ratio of $N_2/N$ is continuously, automatically adjusted to maintain the finished diameter within close tolerances. At the same time, N, is continuously modulated in order to maintain the load cell reading $P_d$ within close limits. One of the reasons for the load cell reading to vary is that some materials, such as steel, is not completely chemically homogenous. This is primarily with respect to the carbon content. A change in N, alters the strain rate hardening since it is directly proportional to N, or V. A change in $V_1$ also alters the quenching rate because even though the temperature gradient is maintained by appropriate adjustments in heat input, $$\left(\frac{dT}{de}\right)$$

which is negative on the cooling side of the Temperature Gradient Curve, is changed proportionately to $V_1$. The effect of this is generally to produce an increase in the UTS of the finished product with an increase in $V_1$.

The combined effect is an increase in the total hardening of the material in the deformation zone. Modulating $V_1$ serves to maintain the stability of the reduction cone and thereby the consistency of the cross-sectional area of the finished material. $\sigma$ $$\text{Because } \bar{\sigma} = \frac{Pd(1 - V_1 V_2)}{A_2 \ln(V_2/V_1)}$$

Because where$\bar{\sigma}$ is the average strength or flow stress of all the material plastically deforming in the deformation zone, see proceedings of 14th National Science Foundation Conference 1987, *THERMASTRESS PROCESS CONTROL SYSTEM; ANALYSIS FOR APPLICATION OF PROCESS ON A COMMERCIAL SCALE*, Daniel J. Borodin, Principal Investigator. is the basic parameter which relates to stability of the dieless drawing process.

Since $$\left[\frac{(1 - V_1/V_2)}{A_2 \ln(V_2/V_1)}\right]$$

is essentially constant; $\bar{\sigma} = P_2 \times \text{Constant}$. Hence $P_2$ or the reading of the load cell is directly proportional to $\bar{\sigma}$. When the total softening of the deformation zone expressed by $\sigma$, attributable to reduction in cross-sectional area is in balance with the total hardening of the deformation zone expressed by:

$$\frac{d\sigma}{d\epsilon} = \left(\frac{\partial\sigma}{\partial\epsilon}\right) + \left(\frac{\partial\sigma}{\partial\dot{\epsilon}}\right)\left(\frac{d\dot{\epsilon}}{d\epsilon}\right) + \left(\frac{\partial\sigma}{\partial T}\right)\left(\frac{dT}{d\epsilon}\right)$$

then steady state is maintained in the deformation zone.

Having described my invention, I claim:

1. A method for changing a metallic material having a first microstructure, and a first cross-section, said material being capable of changing to a second microstructure upon being heated to a critical temperature and then being cooled, said method comprising the steps of:

continuously moving the material along a path of motion adjacent a heating means to progressively heat the material while it is in motion, according to a selected temperature gradient, to a level above said critical temperature level;

then, as the material continues in motion, reducing the temperature of the material such that the material changes to a second micro-structure that depends upon said selected temperature gradient, and elongating the material as it is in said motion during both the heating step and the cooling step.

2. A method as defined in claim 1, in which the rate of temperature increase is variable in the direction of said path of motion, and the heating means includes means for selectively adjusting the rate of temperature increase.

3. A method as defined in claim 1 in which the material is moved at a velocity along said path of motion such that the temperature gradient curve of the material adjacent the heating means is generally stable.

4. A method as defined in claim 1, in which the material is heated adjacent a plurality of adjustable heating means spaced along said path of motion, each of the heating means being individually adjustable for adjusting the temperature of the material according to differences between the actual material temperatures and corresponding points on said selected temperature gradient.

5. A method as defined in claim 1, in which the velocity of the material adjacent said heating means is adjustable to achieve a modulation in strain rate hardening.

6. A method as defined in claim 1, in which the material temperature is reduced by passing the material through a plurality of quenching zone means, each quenching zone means being adapted to reduce the material temperature according to the selected temperature gradient.

7. A method as defined in claim 1, in which the material has a first diameter, prior to being heated, and a second, lesser diameter after it has been cooled, and the means for moving the material include upstream drive means, and downstream drive means, disposed on opposite sides of the heating means, and the second diameter of the material depends upon the ratio of the velocity of downstream drive means to the velocity of the upstream drive means, and including means for adjusting said ratio according to the second diameter of the material.

8. A method as defined in claim 7, in which the downstream drive means is driven by the upstream drive means.

9. A method as defined in claim 7, in which the downstream drive means is driven by a variable speed transmission.

10. A method as claimed in claim 1, in which the material is a steel alloy.

11. A method as claimed in claim 1, in which the material is a steel material, and the critical temperature is the Bainitic nucleation temperature for the steel material.

12. A method as defined in claim 1, in which the temperature of the material is reduced to form a generally constant temperature plateau as the temperature passes down through said critical temperature.

13. A method as defined in claim 1, in which the material is a steel alloy, and the temperature is reduced such that at least a portion of the material is nucleated to a Bainitic microstructure.

14. A method as defined in claim 1, in which the material comprises a nonferrous alloy.

15. A method as defined in claim 1, in which the material is a steel alloy, and said heating step comprises heating said material to a temperature sufficient to Austenitize it.

16. A method as defined in claim 1, in which the elongation step comprises elongating the material sufficient to change the critical temperature level.

17. A method as defined in claim 1, in which the material is moved and elongated between two spaced points by providing a first rotatable drive means located upstream from said heating means and a second rotatable drive means located downstream from said heating means, said second rotatable drive means being rotated at a rate of rotation greater than the first rotatable drive means and at a ratio proportional to the desired cross-section reduction ratio of the material.

18. A method as defined in claim 1, in which the material comprises a steel material, and said method includes:

moving the steel material between two spaced points;

said heating means being disposed between said spaced points;

applying an elongating force on the material between the two spaced points;

heating said steel material to a temperature such that its yield point drops below the level of the applied force whereby the steel material elongates and the cross-section of the steel material is reduced as a result of the application of said elongating force; and subsequently cooling said steel material.

19. A method as defined in claim 1, in which the material is steel wire, and forms a neck in the vicinity of the heating means, and the heat being applied to the material is adjusted to maintain the neck in a relatively fixed position with respect to said heating means.

20. A method as defined in claim 1, in which the metallic material is moved and elongated between two spaced points by providing a first rotatable drive means located upstream from said heating means, and a second rotatable drive means located downstream from said heating means, said second rotatable drive means being rotated by the first rotatable drive means faster than said first rotatable drive means faster than said first rotatable drive means and at a ratio proportional to the desired cross-section reduction ratio of said metallic material; and including the step of gaging the actual reduced cross-section of the metallic material after the temperature has been reduced, and comparing the gauged cross-section to a desired cross-section to determine an error, and adjusting the rate of rotation of the drive means according to said error.

21. A method as defined in claim 1, in which the moving material forms a reduction cone, and the chemistry of the material varies in the direction the material travels through the reduction cone, and the material is moved by applying a tensile load thereto, and including the steps of measuring the net load on the material by load cell means such that changes in the material chemistry is reflected in the load cell measurements, and adjusting the velocity of the material approaching the reduction cone according to the load cell measurements to maintain the stability of the reduction cone.

22. A method of elongating and reducing the cross-section of a metallic material to a desired cross-section, comprising the steps of:

continuously moving the material along a path of motion adjacent a heating means to progressively heat the material while it is in motion, according to a selected temperature gradient;

applying an elongation force on the metallic material as it is in motion during the heating step;

raising the temperature of the material during the heating step to a sufficient temperature that the yield point of the material drops such that the material elongates and is reduced in cross-section as the result of the application of the elongating force;

cooling the material in a quenching means as the material continues in motion;

measuring the reduced cross-section of the material; and adjusting the ratio of the velocity of the material prior to being heated by said heating means to the velocity of the material after being cooled by said quenching means according to a comparison between the actual cross-section and the desired reduced cross-section of the material.

23. A method for changing a metallic material having a first microstructure, and a first cross-section, said material being capable of changing to a second microstructure upon being heated to a temperature rendering it plastic and then being cooled, said method comprising the steps of:

continuously moving the material along a path of motion adjacent a heating means to progressively heat the material while it is in motion, according to a selected temperature gradient, to a level rendering the material plastic;

then, as the material continues in motion, reducing the temperature of the material such that the material changes to a second micro-structure that depends upon said selected temperature gradient;

elongating the material as it is in said motion during both the heating step and the cooling step;

monitoring variations in the chemistry of the moving material; and adjusting the velocity of the material as it approaches the heating means, according to variations in said material chemistry.

24. A method for changing a steel material having a first microstructure, said material being capable of changing to a second micro-structure upon being heated to a critical temperature and then being cooled, said method comprising the steps of:

continuously moving the material along a path of motion adjacent a heating means to progressively heat the material while it is in motion to a temperature above the Austenite conversion temperature for the steel material;

then as the material continues in motion, reducing the temperature of the material according to a selected temperature gradient such that the material changes to a second micro-structure that depends upon said selected temperature gradient, and elongating the material as it is in said motion during both the heating step and the cooling step.

25. A die-less method for reducing the cross-section of a metallic material capable of being rendered plastic upon being heated, said material having a first cross-section, comprising the steps of:

continuously moving the material along a path of motion with respect to a plurality of individually adjustable heating means to progressively heat the material to render the material plastic;

monitoring the actual temperature gradient of the material as it is being passed adjacent the heating means, and adjusting the heating means according to differences between the actual temperature gradient and a selected temperature gradient; and applying an elongating force on the steel material in the direction of the material motion while the material is in motion to reduce the material cross-section to a second cross-section; and reducing the material temperature while it is in said continuous motion.

26. A method as defined in claim 1, in which the material is steel, and the temperature is reduced to a level at which Bainitic micro-structure dominates, and including the step of maintaining the temperature of the material generally constant for a period of time sufficient to form a predetermined percentage of Bainite in the steel material.

* * * * *